US005622515A

United States Patent [19]

Hotea et al.

[11] Patent Number: 5,622,515

[45] Date of Patent: Apr. 22, 1997

[54] GROUNDING ELECTRICAL LEADS

[75] Inventors: Gheorghe Hotea, Griesheim; Harald M. Lutsch, Dietzenbach, both of Germany

[73] Assignee: The Whitaker Corporation, Wilmington, Del.

[21] Appl. No.: 338,078

[22] Filed: Nov. 14, 1994

[30] Foreign Application Priority Data

Nov. 23, 1993 [GB] United Kingdom ..... 9324064

[51] Int. Cl.[6] ..... H01R 4/24

[52] U.S. Cl. ..... 439/398; 439/402; 439/865; 439/907; 29/884

[58] Field of Search ..... 439/397–399, 439/402, 403, 885, 865, 907; 29/882, 884

[56] References Cited

U.S. PATENT DOCUMENTS 3,842,392 10/1974 Aldridge et al. ..... 439/398
3,937,549 2/1976 Hughes ..... 339/97 C
4,834,670 5/1989 Rodondi et al. ..... 439/398
4,964,811 10/1990 Hayes, Sr. ..... 439/398

*Primary Examiner*—Neil Abrams
*Attorney, Agent, or Firm*—Driscoll A. Nina

[57] ABSTRACT

A set of electrical terminals is provided for interconnecting and grounding electrical leads of a harness, for example an automotive engine harness. Each terminal comprises two spaced pairs of spring beams defining a pair of aligned, insulation displacement slots for receiving a common electrical lead. The spring beams of each pair are defined by a pair of juxtaposed loops. The loops of all of the terminals are connected together to provide a cage-like structure by a front wall, a rear wall and a base. One end of each loop is connected to the front wall and the other end of each loop is connected to the rear wall. Lead strain relief ferrules project rearwardly from the base and the rear wall in a single row in closely spaced relationship. The rear wall is secured to the base by means of a flange which has been struck out from the base and which engages over a neck connecting one of the ferrules to the rear wall. A plurality of the sets of terminals may be connected by carrier strips and disposed in the separate housings which are latched together in modular form.

17 Claims, 8 Drawing Sheets

GROUNDING ELECTRICAL LEADS

BACKGROUND OF THE INVENTION

1. Field of the Invention

This invention relates to sets of electrical terminals for use in commonly grounding leads of an electrical harness, for example an automotive engine harness. The invention also concerns a method of manufacturing such a terminal set and to a housing and cover assembly for such a terminal set.

2. Description of the Prior Art

A typical electrical harness, for example an engine harness for an automotive vehicle comprises a main electrical connector and a multiplicity of satellite electrical connectors connected to the main connector by insulated electrical leads. The satellite connectors are provided for mating with corresponding terminals of appliances of the vehicle, for many of which a ground connection is needed. Conventionally, grounding leads for these appliances are connected to ground by means of separate electrical terminals which may, or may not, be disposed in a common housing.

In the interest of economy, these grounding terminals are preferably identical and comprise a set of stamped and formed electrical terminals, each terminal comprising two spaced pairs of spring beams defining a pair of aligned insulation displacement slots for receiving a common electrical lead, and a lead strain relief ferrule aligned with the lead receiving slots.

SUMMARY OF THE INVENTION

A set of terminals according to the present invention, is characterised in that the spring beams of each pair are defined by a pair of juxtaposed loops, the loops of all of the terminals of the terminal set being connected together to provide a cage-like structure, by a front wall, a rear wall and a base, one end of each loop being connected to the front wall and the other end of each loop being connected to the rear wall, the lead strain relief ferrules projecting rearwardly from the base and the rear wall in a single row in closely spaced relationship and the rear wall being secured to the base.

Such a composite set of electrical terminals can more readily be loaded into an insulating housing therefore, than can separate electrical terminals and provides for high contact density and for ease of manufacture. A plurality of these composite sets of terminals can conveniently be manufactured by conventional die stamping and forming techniques, according to the number of leads of a harness which are to be grounded. As disclosed herein, the composite terminal sets, remaining connected thereto by the carrier strips used in the progressive forming operation, can be disposed in separate housings which are so assembled together in modular form, that the housings are rigidly connected together so that the carrier strips cannot be bent and thus rendered brittle when the connected housings are handled.

Preferably, each lead strain relief ferrule, which is of substantially U-shaped cross section comprises a pair of side walls upstanding from opposite edges of a base, one side wall having a crimping lug upstanding from each end thereof and the other side wall having a single crimping lug upstanding therefrom between the crimping lugs of the one side wall. Thus, in a stamped out bank, described herein, for forming the terminal set, portions of the bank which are to be formed into lead strain relief ferrules, may be closely juxtaposed with each other, a part of one ferrule forming portion, for providing a single crimping lug, being interdigitated with parts of an adjacent ferrule forming portion, for providing two crimping lugs. The scrap is also reduced when the blank is stamped out.

The front wall of the set of terminals may be formed with a mating member, for example, an electrical receptacle or a tab, for connection to a mating member connected to ground; or a ground lead may be soldered, for example, to the set of terminals.

A method of manufacturing a set of terminals according to the invention and a housing and cover assembly for a set of terminals according to the invention, is also disclosed.

DETAILED DESCRIPTION OF THE PREFERRED EMBODIMENT

Figure 1:
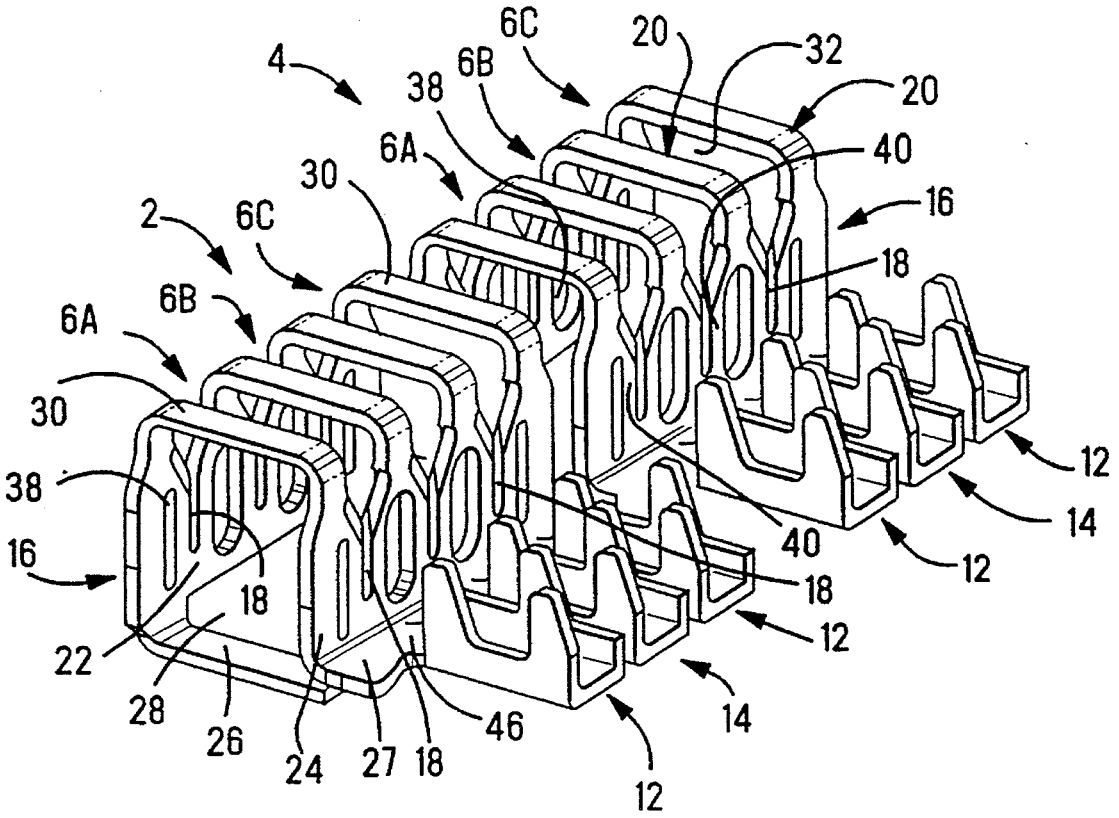
FIG. 1 is an isometric view of two sets of electrical terminals according to a first embodiment for use in branch electrical connectors for commonly grounding leads of an electrical harness, for example, an automotive engine harness.
Figure 4:
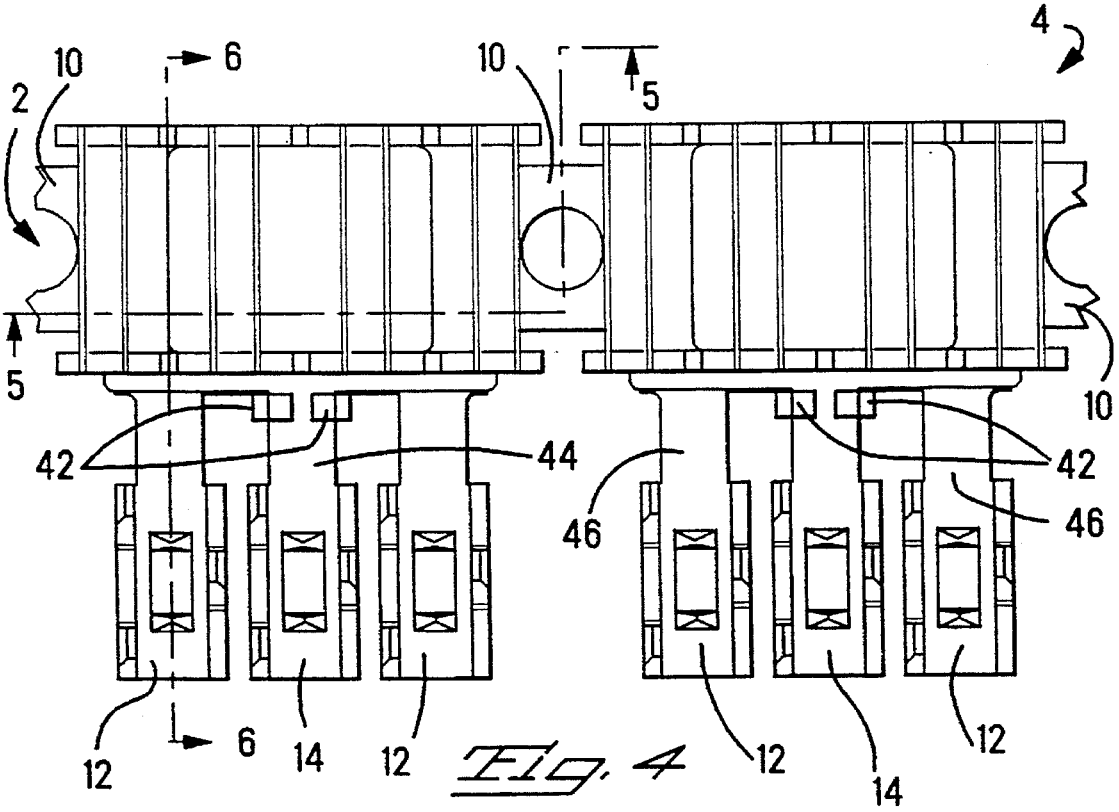
FIG. 4 is a plan view of the two terminal sets, drawn to a reduced scale.
Figure 2:
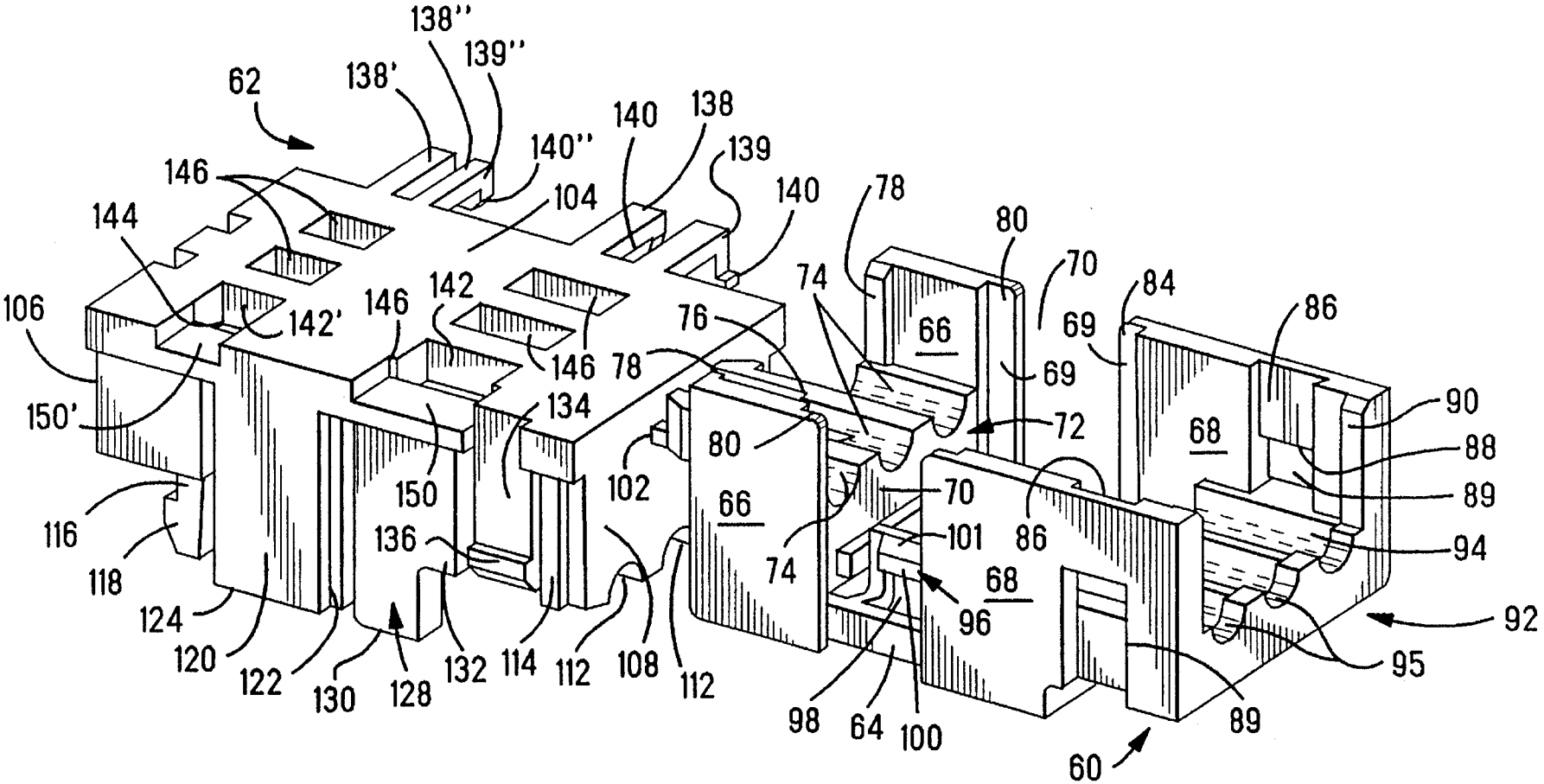
FIG. 2 is an isometric view of an insulating housing for receiving one of the sets of terminals, and a cover for the housing.
Figure 3:
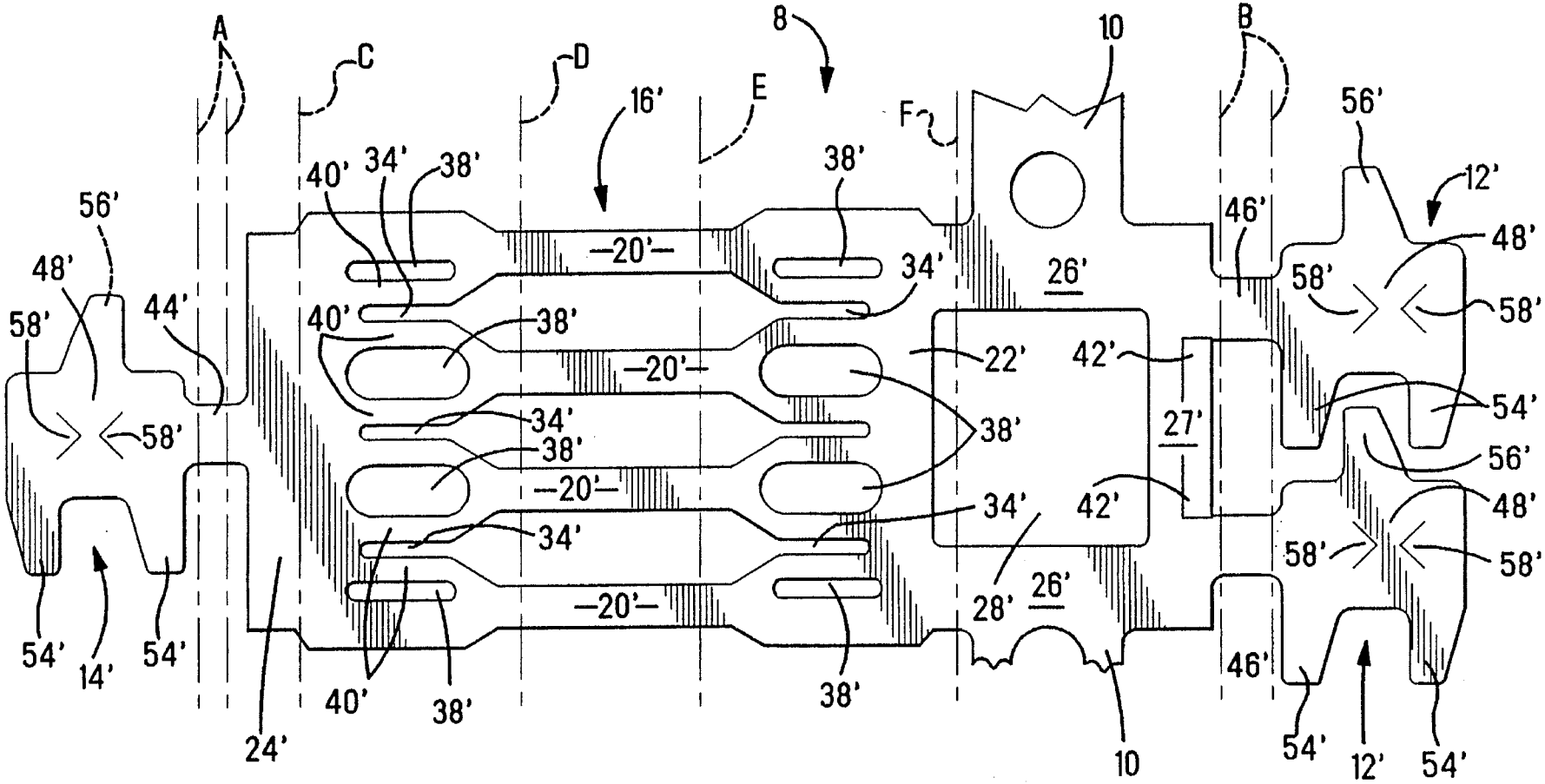
FIG. 3 is an enlarged plan view of a sheet metal blank to be formed into one of the terminal sets.

As shown in FIG. 1, first and second identical sets 2 and 4, respectively, of electrical grounding terminals, for use in a branch electrical connector each comprise three grounding terminals 6A, 6B and 6C. Both of the terminal sets 2 and 4 were stamped and formed from a single piece of sheet metal stock by means of a progressive die stamping and forming operation. FIG. 3 shows a stamped out sheet metal blank 8 before its formation into a finished terminal set. The blank 8 is connected to identical blanks (not shown) by means of carrier strips 10. After the terminal sets have been formed from the blank, one, or both, of the carrier strips 10 may be allowed to remain in place as shown in FIG. 4, so that the sets 2 and 4 and, if required, one or more further terminal sets, remain electrically connected to each other.

Each terminal set, 2 and 4, as shown (FIGS. 1, 5 and 6), comprises three lead strain relief ferrules, namely two outer ferrules 12 of the terminals 6A and 6C, a central, or inner ferrule 14 of the terminal 6B, and a cage-like structure 16 defining three pairs of spaced, aligned, lead receiving slots 18 of the terminals 6A, 6B and 6C respectively. Each pair of aligned slots 18 is aligned with a respective one of the ferrules 12 and 14. Each slot 18 is defined by a pair of adjacent loops 20, best seen in FIG. 6, of the sheet metal, each terminal set 2 and 4, therefore, having four juxtaposed loops 20.

Figure 5:
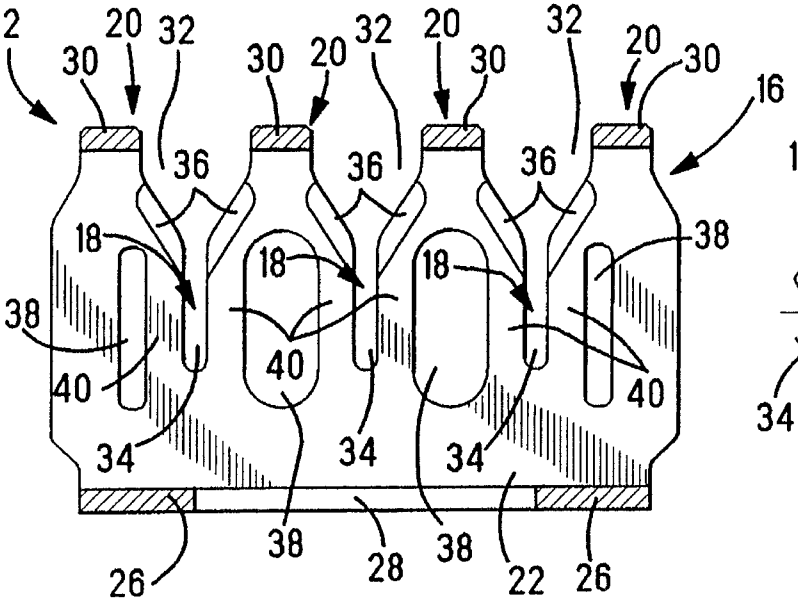
FIG. 5 is an enlarged sectional view taken on the lines 5—5 of FIG. 4.

Each loop 20 is connected at one end thereof to a front wall 22 of the cage-like structure 16, and at the other end thereof to a rear wall 24 of the structure 16. The front wall 22 is connected at its lower end, to a base comprising side straps 26 and a rear strap 27, defining, in co-operation with the wall 22, a central rectangular latching opening 28. The loops 20 have top walls 30. Each slot 18 has an upwardly flared, lead receiving mouth 32, as best seen in FIG. 5, merging into a wire receiving portion 34. Each loop 20 has a chamfered insulation displacing edge 36 bounding one side of a respective lead receiving slot 18 and extending along the mouth 32 of the slot 18 and terminating in the wire receiving portion 34 thereof. The loops 20 have through openings 38 to define resiliently deflectable spring beams 40 which in turn define the wire receiving portions 34 of the slots 18. The loop 20 of the cage-like structure 16 of each terminal set is held in its looped condition by means of a pair of flanges 42 which have been bent out from the strap 27 and engage over a neck 44 connecting the centre ferrule 14 of the terminal set to the rear wall 24. The ferrules 12 are connected to the rear strap 27 by means of necks 46. The necks 44 and 46 support the ferrules above the straps 26 and 27.

Figure 6:
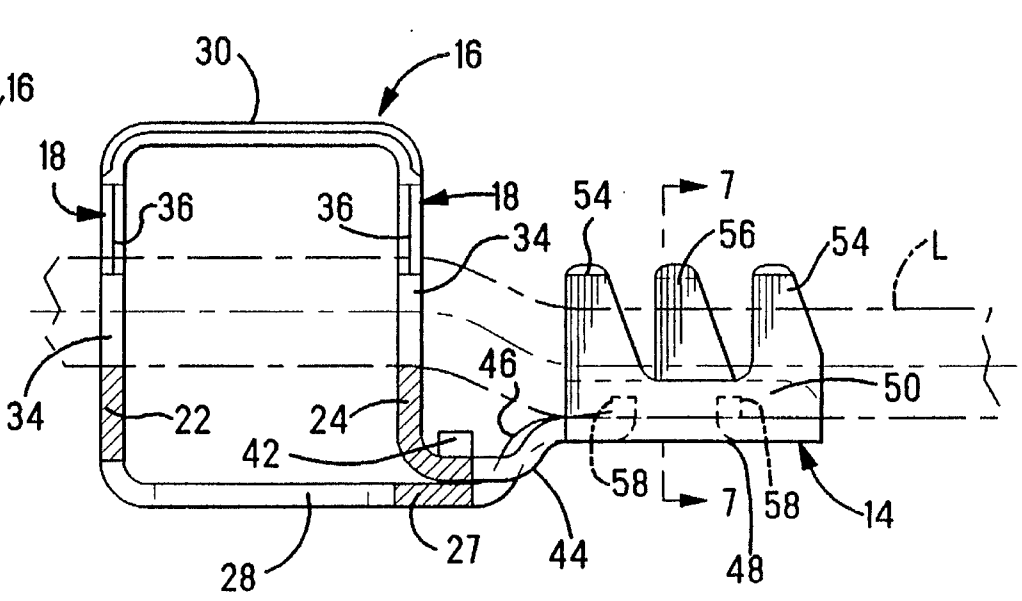
FIG. 6 is an enlarged sectional view taken on the lines 6—6 of FIG. 4.
Figure 7:
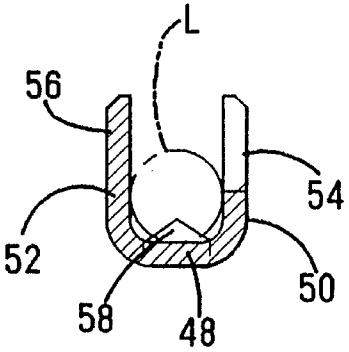
FIG. 7 is a view taken on the lines 7—7 of FIG. 6.
Figure 8:
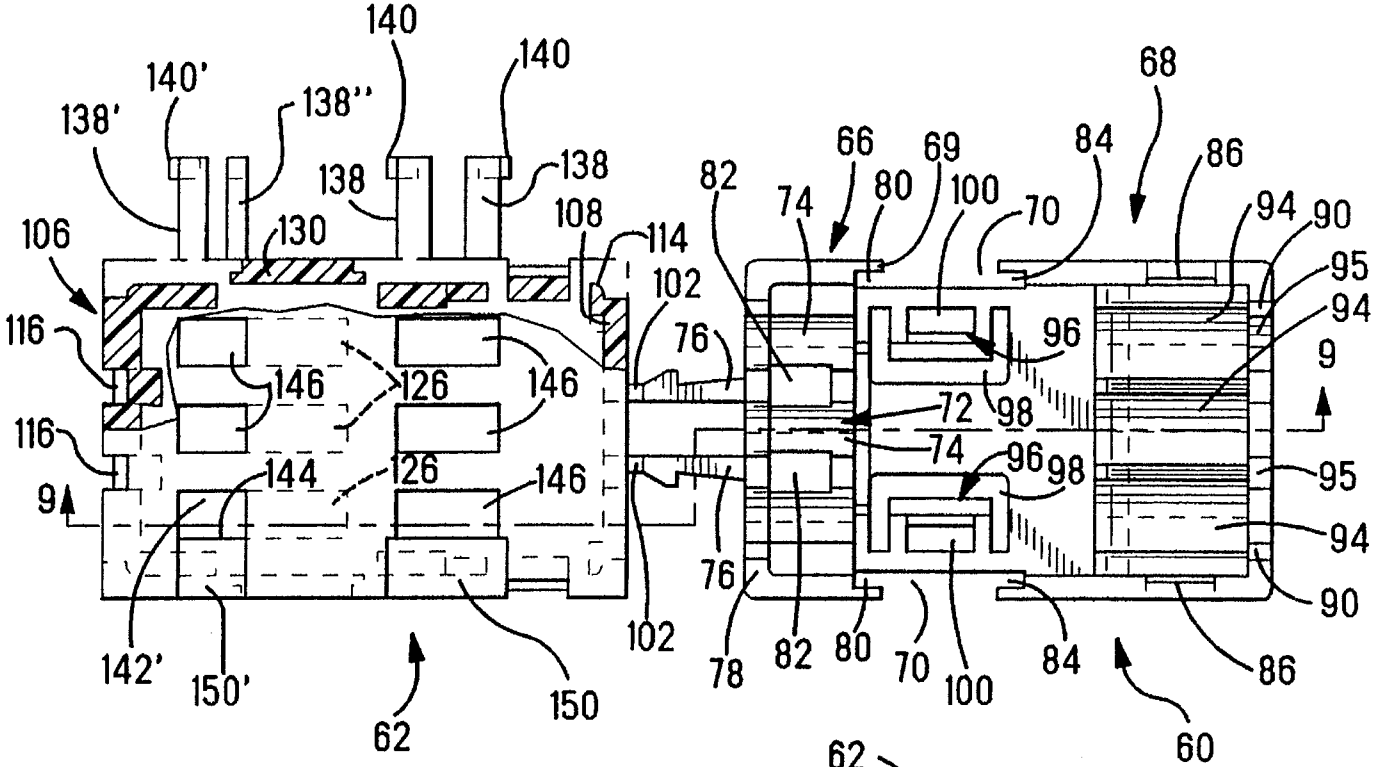
FIG. 8 is a plan view of the housing and its cover, shown partly in section.
Figure 11:
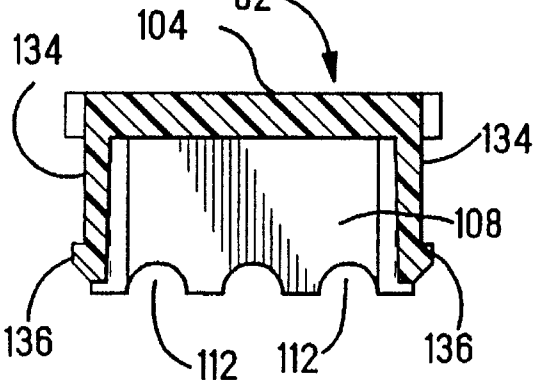
FIG. 11 is a view taken on the lines 11—11 of FIG. 9.
Figure 9:
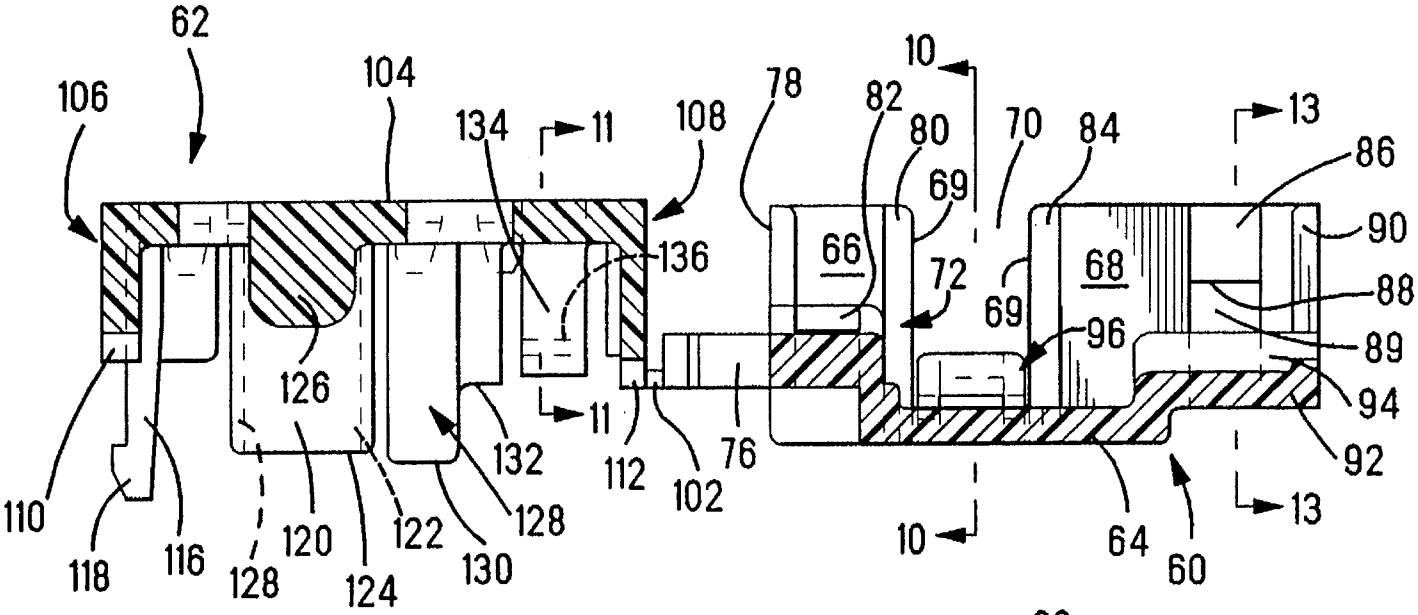
FIG. 9 is a view taken on the lines 9—9 of FIG. 8.
Figure 10:
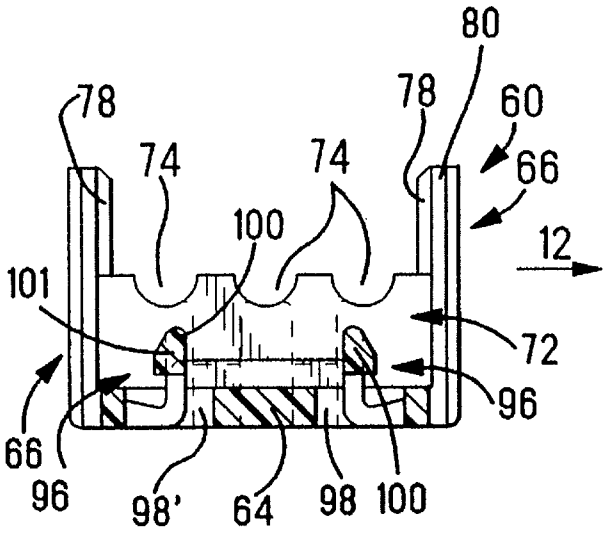
FIG. 10 is a view taken on the lines 10—10 of FIG. 9.

Each ferrule 12 and 14 comprises, as best seen in FIGS. 6 and 7, a base 48 from which upstand side walls 50 and 52, respectively. There upstand from each end of the side wall 50 a crimping lug 54, the side wall 52 having a single central crimping lug 56 upstanding therefrom. The base 48 has triangular, lead retention spurs 58 struck out therefrom. An insulated lead L can be electrically connected to each terminal 6A, 6B and 6C of each terminal set 2 and 4, by forcing the lead L into the respective lead receiving slot 18 by way of its mouth 32, so that the edges 36 displace the insulation of the lead L during its insertion, whereby as the lead L is forced down into the slot 18, the metal core of the lead enters the wire receiving portion 34 of the slot 18 thereby resiliently slightly displacing the spring beams 40 defining the said portion 34, away from each other, whereby the lead core is permanently and firmly electrically connected to both of the terminal sets 2 and 4, despite any vibration to which the terminal sets may be subjected when in use. Electrical connection between each terminal and the lead core, is further protected by crimping the lugs 54 and 56 about the insulation of the lead L so that the lead is firmly gripped by the ferrule, the spurs 58 biting into the insulation of the lead so that any tensile stress to which the lead may be subjected when the terminal sets are in use, is taken up by the ferrule.

The manufacture of a terminal set will now be further described with reference to FIG. 3, which is a plan view of a flat sheet metal blank 8, in which those portions and features of the terminal sets which have been described above bear the same reference numerals as those used above, but with the addition of a prime symbol.

As shown in FIG. 3, the blank 8, which is elongate, has projecting from one end two spaced, juxtaposed lead strain relief ferrule forming portions 12' for forming into the ferrules 12, and a lead strain relief ferrule forming portion 14' for forming into the ferrule 14. Juxtaposed loop forming portions 20' for forming into the loops 20 are disposed intermediate the portions 12' and 14'. Each portion 20' is connected at one end to a front wall portion 22' and at its other end to a rear wall portion 24'. The front wall portion 22' is connected to side strap portions 26' which are in turn connected to a rear strap portion 27' having stamped out flange forming portions 42'. The ferrule forming portions 12' are connected to the strap portion 27' by neck portions 46' and the ferrule forming portion 14' is connected to the rear wall portion 24' by a neck portion 44'. The carrier strips 10 project laterally from respective ones of the strap portions 26'. In the interest of contact density and economy the lug forming portion 56' of one ferrule forming portion 12' projects between the lug forming portions 54' of the other ferrule forming portion 12'.

The sheet metal blank 8 having been stamped out as shown in FIG. 3, the portions 12' and 14' for forming into the ferrules 12 and 14 are rolled up to the shape best seen in FIG. 6 and 7, the portions 14' being rolled up in the opposite direction to the portion 12', that is to say, downwardly as seen in FIG. 3. The neck portions 44' and 46' of the blank 8 are bent along fold lines A and B, respectively, to the configuration shown in FIG. 6. The portion 24' of the blank 8 is bent up along fold line C and the cage-like structure 16 is formed by bending the blank 8 along transverse parallel fold lines D, E and F distributed lengthwise of the blank 8; so that the formed ferrule 14 lies between the formed ferrules 12 with the formed neck 44 disposed between the portions 42' of the strap portion 27'. The rear wall portion 24' is thereby brought into parallel relationship with the front wall portion 22' rearwardly thereof. The portions 42' are then bent up and over the neck 44 to provide the flanges 42 which hold the cage-like structure 16 in its folded over condition. One or more identical other blanks (not shown) formed, as described above, identically with the blank 8 and connected thereto by carrier strips 10, may remain connected to the blank 8 or may be severed therefrom as required, in accordance with the number of leads L which are to be grounded.

An advantage of the method of manufacture just described, is that the close spacing of the ferrules 12 and 14 enables high contact density to be achieved.

Alternatively, two of the lead strain relief ferrules could be connected to the rear wall, one of the lead strain relief ferrules being connected to the rear strap of the base, and the rear strap having a pair of flanges securing the necks of said two strain relief ferrules to the rear strap of the base.

Figure 13:
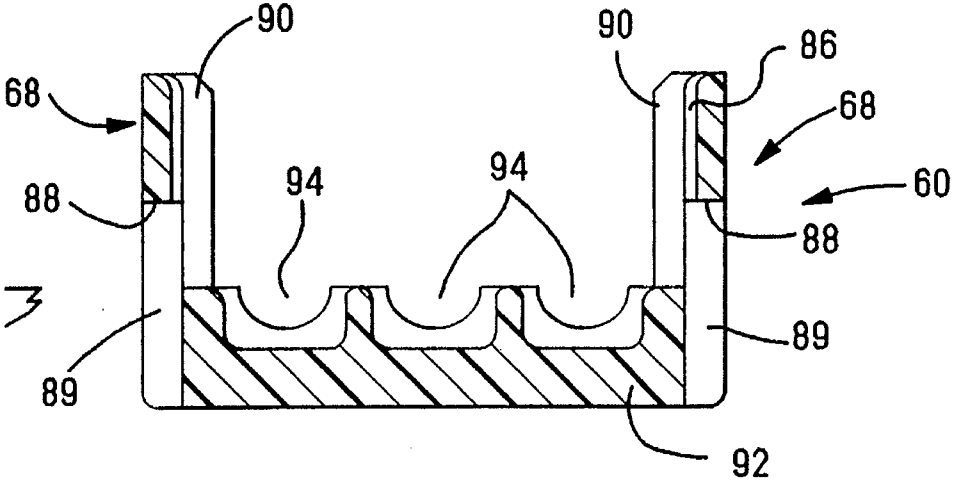
FIG. 13 is a view taken on the lines 13—13 of FIG. 9.

A housing 60 having a cover 62, for receiving one of the terminal sets 2 and 4, to provide a grounding electrical connector will now be described with reference to FIGS. 2 and 8–14. The housing 60 and the cover 62 were moulded in one piece from a suitable insulating material, for supply to the end user in one piece form. The-housing 60 comprises a base wall 64 from each of opposite lateral edges of which upstand a forward side wall 66 and a rear side wall 68. The side walls 66 and 68 on each lateral edge of the base wall 64 are spaced from each other to define between their respective rear and forward edges 69, a rectilinear, carrier strip receiving slot 70 extending between the tops of the walls 66 and 68 and the base wall 64. Between the two side walls 66 is a lead end portion support plate 72 having three spaced, parallel lead end portion receiving grooves 74 extending parallel to the walls 66. The support plate 72 is provided by a raised forward end portion of the base wall 64. A pair of latch arms 76 project forwardly from the plate 72. Each wall 66 has, at its forward end, an internal rib 78 extending from the top wall of the 66 down to the plate 72 and at its rear end, an internal groove 80 extending from the top of the wall 66 to the base wall 64. On either side of the centre groove 74 is a latch arm receiving opening 82 extending through the support plate 72. Each side wall 68 has, at its forward end, an internal groove 84 facing, and parallel to, the groove 80 of the side wall 66 on the same edge of the base wall 64. Rearwardly of the groove 84 each side wall 68 has extending from its top edge, a latch arm receiving internal groove 86 terminating in a latching shoulder 88 provided by the top wall of an opening 89 in the side wall 68, as best seen in FIG. 13. Each side wall 68 has at its rear end, an internal rib 90 having a chamfered top edge. Between the side walls 68, a raised portion of the base wall 64 is formed as a ferrule support plate 92 having ferrule receiving grooves 94 which communicate with respective lead receiving notches 95 at the rear end of the plate 92. Between the side walls 66 and 68 and in alignment with the slots 70, there upstand from the base wall 64, a pair of resilient latches 96, best seen in FIG. 10, projecting upwardly from the outer walls of through openings 98 in the base wall 64 and having outwardly projecting latching heads 100, surmounted by inclined cam follower surfaces 101.

A terminal set 2 or 4, with leads L terminated thereto, as described above, can be inserted into the housing 60 so that the latching heads 100 of the latches 96 enter the central latching opening 28 of the terminal set, are cammed inwardly by engagement with the straps 26 against the cam follower surfaces 101 and then resile to engage over the straps 26. The terminal set is guided into the housing 60 by the sliding engagement of the ends of the cage-like structure 16 into the grooves 80 and 84 of the side walls 66 and 68 of the housing 60. The edges 69 of each, slot 70 serve to guide a respective carrier strip 10 down against the base wall 64.

The cover 62 is connected to the ends of the latch arms 76 of the housing 60 by frangible necks 102. When the cover 62 is to be assembled to the housing 60, the end user fractures the necks 102 to allow this. The cover 62 comprises a top wall 104 from which depend a forward end wall 106 and a rear end wall 108. The end wall 106 is formed with notches 110 for holding down the end portions of the leads L which project forwardly from the cage-like structure 16, in the grooves 74 of the housing 60. The end wall 108 is formed with notches 112 for holding down the leads L, in the notches 95 of the housing 60 and with opposed lateral guide ribs 114 each for engaging the rear face of a respective rib 90 of the housing 60. There depend from the forward end of the top wall 104 through slots in the end wall 106, a pair of latch arms 116 having latching heads 118, for insertion through the latching openings 82 in the support plate 72 of the housing 60, so that the latching heads 118 latch against the lower face of the plate 72. Rearwardly of, and outwardly of, the latch arms 116 there depend from opposite lateral edges of the top wall 104 carrier strip hold down plates 120 having grooved margins 122 for slideably receiving the edges 69 of the slots 70, and bottom ends 124 for holding down the carrier strips 10 against the base wall 64 of the housing 60. Between the hold down plates 120 there depend from the top wall 104 three lead hold down members 126 for insertion into the mouths 32 of the lead receiving slots 18 of the structure 16 to hold down the leads L in the slots 18. Rearwardly of the plate 120 there depend from opposite edges of the top wall 104 respective hold down plates 128 having bottom ends 130 and 132 shaped from holding down the necks 46 of the ferrules 12 against the base wall 64 of the housing 60. Between the plates 128 and the rear wall 108, latch arms 134 depend from opposite lateral edges of the top wall 104 for insertion into respective ones of the grooves 86 of the side walls of the housing 60 so that latching heads 136 of the arms 134 latchingly engage against the latching shoulders 88.

When the cover 62 has been assembled to the housing 60, it is securely fixed thereto by means of the latch arms 116 and 134 and the terminal set is secured against any movement relative to the housing 60 by virtue of the latches 96 and the hold down plates 120 and 128. The cage-like structure 16 is closely confined between the hold down plates 120 and the leads L are held down in the lead receiving slots 18 by the hold down members 126 thereby to ensure the integrity of the electrical connections between the lead cores and the spring beams 40.

Figure 14:
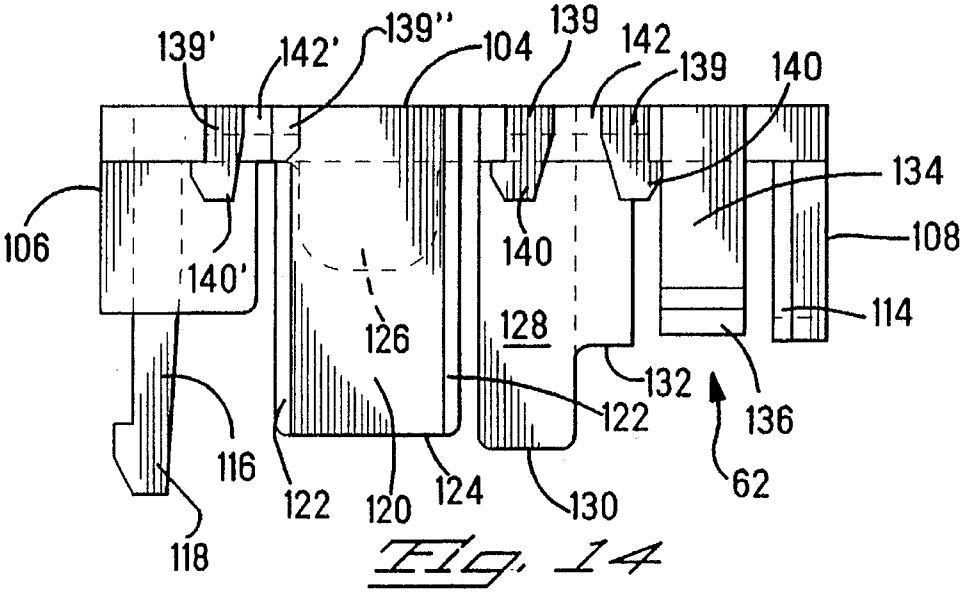
FIG. 14 is a view taken in the direction of the arrow 14 in FIG. 12, shown partly in section.
Figure 12:
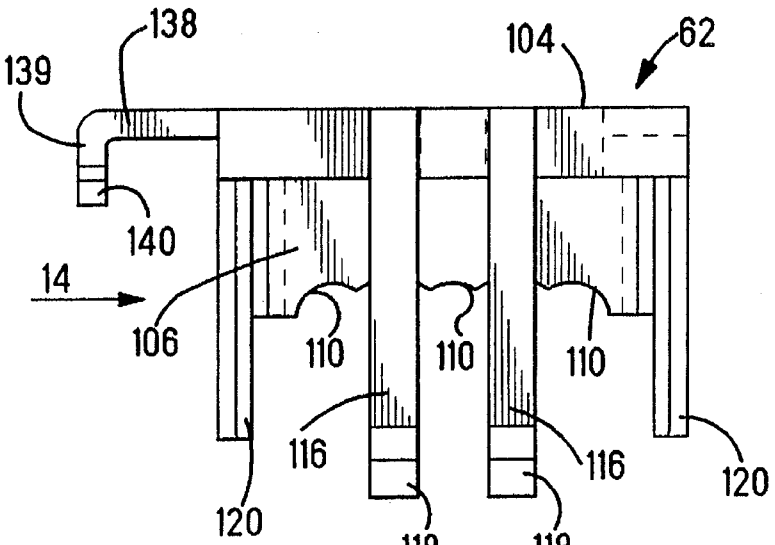
FIG. 12 is a view taken in the direction of the arrow 12 in FIG. 9.

The cover 62 further comprises means for latching it in modular fashion to the covers 62 of the two further housings 60 each containing a further terminal set, all the terminal sets being electrically connected to each other by carrier strips 10. The latching means comprise two pairs of hooks 138, and 138', 138", which project laterally from one lateral edge of the top wall 104 of the cover 62. The hooks 138, 138', 138", have hook portions 139, 139', 139", depending normally from their free ends The hook portions 139 of the pair of hooks 138 are provided with oppositely projecting latching heads 140. The hooks 138' and 138" are narrower than the hooks 138, the hook 138" being also narrower than the hook 138'. The hook portion 139' has a latching head 140' which projects forwardly of the cover, whereas the hook 138" has a latching head 140" which projects from its hook portion 139" towards the cover 62. The hooks 138' and 138" are more closely spaced than the hooks 138. The top wall 104 of the cover 62 has, near its margin opposite to said lateral edge, two through latching openings 142 and 142' for receiving the hook pairs 138 and 138', 138", respectively, of the cover 62 of one of said further housings. The opening 142' is somewhat narrower than the opening 142. In order to engage the pair of hooks 138 in the opening 142, the hooks of the pair are pressed slightly towards each other and are released when the heads 140 have passed through the opening 142 so that the hooks 138 resile whereby the heads 140 thereon latch against the under side of the top wall 104, as shown in FIG. 14 and the hook portions 139 are received in notches 146 of the opening 142 so that the hooks 138 cannot move relative to the housing cover 62. The hooks 138' and 138" are similarly inserted into the opening 142' whereby the latching head 140' latches against the underside of the top wall 104 and the latching head 140" abuts the back edge 144 of the opening 142'. The hooks 138' and 138" are thus locked against movement relative to the cover 62. A series of grounding connectors comprising the covers, the housings, and the terminal sets can accordingly be connected together to provide a single branch connector, sufficiently rigidly to avoid the carrier strips being bent and thus work hardened so as to be brittle, when the strain of grounding connectors is being handled.

The openings 142 and 142' and further through openings 148 in the top wall 104 of the cover 62 allow inspection of the terminal set. Counter-sinks 150 and 150' of the openings 142 and 142' allow the hook portions 139, 139' and 139" to be short and, therefore, robust.

The hooks may be alternatively used, to attach the cover and its housing to a support, for example, in an automotive engine compartment. The latch arms 76 of the housing 60 may also be used for that purpose.

In order to ground the terminal set of the string thereof the leads L may be provided with a connector for connection to ground.

Figure 15:
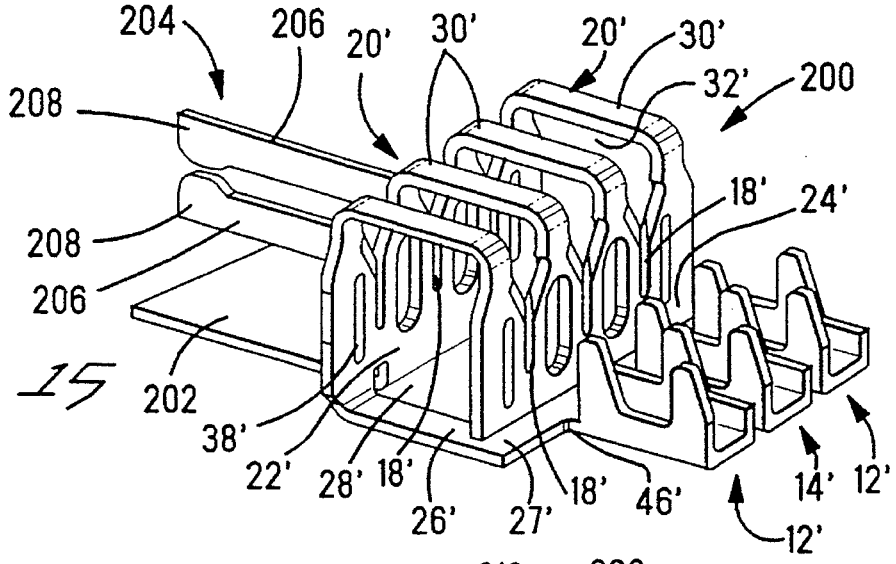
FIG. 15 is an isometric view (not drawn to scale) of a set of electrical terminals according to a second embodiment.
Figure 16:
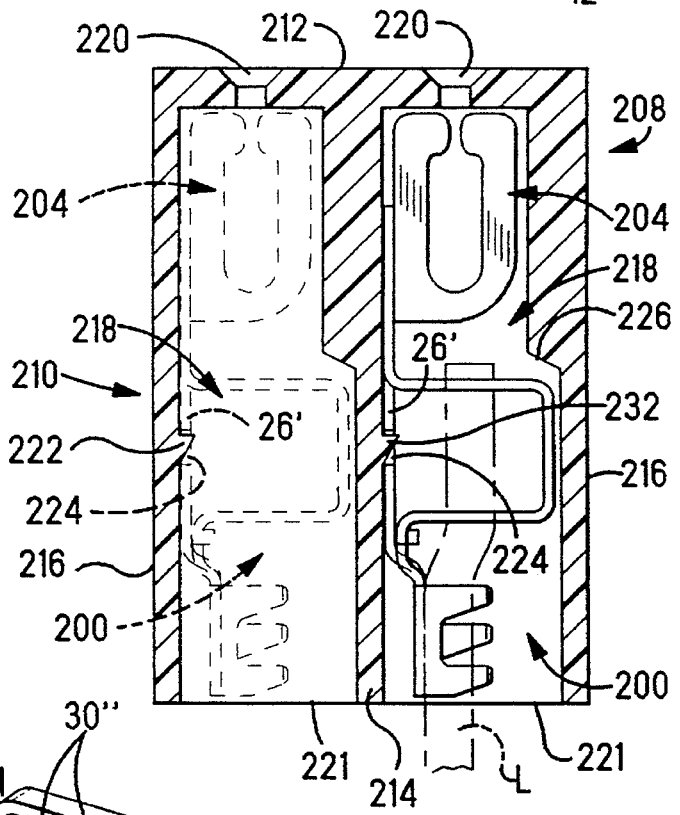
FIG. 16 is a sectional view of an electrical connector comprising sets of terminals according to FIG. 15.

A set 200 of electrical terminals according to a second embodiment of the invention will now be described with reference to FIG. 15. Those parts of the terminal set 200 which are identical with, or which have the same function as corresponding parts described above with reference to the terminal sets 2 and 4, bear the same reference numerals as those parts but with the addition of a prime symbol. The terminal set 200 differs from the terminal sets 2 and 4 in that the front wall 22' has projecting normally and forwardly from its bottom edge a support plate 200. A tab receptacle 204 upstands from the right hand (as seen in FIG. 15) edge of the support plate 202. The receptacle 204 has parallel spring arms 206 projecting forwardly of, and normally of, the front wall 22' in a plane at right angles to the plate 202. The arms 206 have opposed contact nodes 208 for gripping between them a mating tab (not shown) connected to ground, for example to a vehicle chassis. The support plate 202 and the receptacle 204 are formed from the sheet metal stock made available by stamping out the latching opening 28'. Thus in the case of the terminal set 200, the top walls 30' and the side straps 26' would be somewhat longer than the top walls 30 and the side straps 26 of the terminal set 2 or 4. As shown in FIG. 16 an electrical connector 208 comprises a rectangular cross section housing 210 of insulating material having a mating face 212, a terminal receiving face 214 opposite thereto and side walls 216 (only two of which are shown). Two rows of terminal receiving cavities 218 for receiving terminal sets 200 crimped to leads L, extend between the faces 212 and 214 of the housing 210. The mating face 212 is formed with slots 220 for receiving the tabs for mating with the receptacles 204 of the terminal sets 200 in the housing 210. The terminal sets 200 are inserted into the cavities 218 by way of openings 221 in the terminal receiving face 214, until latching spurs 222 of the housing 210, which protrude into the cavities 218, latch into latching windows 224 in the side straps 26' of the terminal sets 200. The plates 202 support the receptacles 204 in alignment with the slots 220 in the mating face. Shoulders 226 of the housing 210 project into the cavities 218 to limit forward movement of the terminal sets 200.

Figure 17:
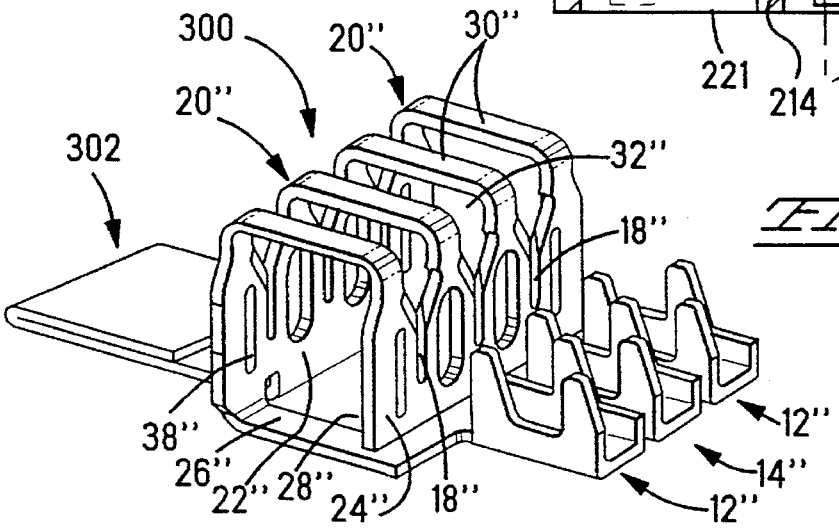
FIG. 17 is an isometric view (not drawn to scale) of a set of electrical terminals according to a third embodiment.

A set 300 of electrical terminals according to a third embodiment of the invention will now be described with reference to FIG. 17. In that Figure, those parts of the terminal set 300, which are identical with, or have the same function as, corresponding parts described above with reference to the terminal sets 200 bear the same reference numerals but with the addition of a further prime symbol. The terminal set 300 differs from the terminal set 200 in that there projects forwardly from the bottom edge of the front wall 22" a folded D tab 302, instead of the plate 202 and the receptacle 204. Terminal sets 300 may be accommodated in a housing similar to the housing 210 but the terminal sets 300 being located so that the tabs 302 project through slots in the mating face of the housing, for mating with receptacles (not shown) connected to ground.

We claim:

1. An electrical terminal set comprising a set of terminals where each terminal includes two spaced pairs of spring beams defining a pair of aligned slots for receiving a common electrical lead, and a strain relief ferrule aligned with the lead receiving slot, wherein the spring beams of each pair of beams are defined by a pair of juxtaposed loops, the loops of all of the terminals of the terminal set being connected together by a front wall and a rear wall with one end of each loop being connected to the front wall and the other end of each loop being connected to the rear wall, whereby a cage-like structure is formed, and the lead strain relief ferrules project beyond the same wall.

2. A set of terminals as claimed in claim 1, wherein the rear wall is secured to a base by means of at least one flange bent out from the base and engaging over a neck connecting the strain relief ferrule of one of the terminals to the rear wall.

3. A set of terminals as claimed in claim 2, wherein the base comprises a pair of side straps connecting the front wall to a rear strap of the base, to define a central latching opening, said at least one flange being bent out from the rear strap.

4. A set of terminals as claimed in any one of the preceding claims, wherein the set of terminals is connected to at least one further and identical set of terminals by means of at least one carrier strip extending laterally from the base.

5. A set of terminals as claimed in claim 1, wherein each lead strain relief ferrule is of substantially U-shaped cross section comprising a pair of side walls upstanding from opposite edges of a base, one side wall having a crimping lug upstanding from each end thereof and the other side wall having a single crimping lug upstanding therefrom between the crimping lugs of the one side wall, the base having at least one lead retention spur projecting between the side walls.

6. A set of terminals as claimed in claim 1, characterized in that a support member projects forwardly from an edge of the front wall and includes an electrical receptacle upstanding therefrom.

7. A set of terminals as claimed in any one of claims 1 to 3, characterized in that an electrical tab projects forwardly from the front wall.

8. A set of terminals as claimed in claim 1, further comprising an insulative housing generally surrounding the set of terminals while leaving the insulation displacement slots and aligned strain relief of each terminal exposed for receiving the lead therein.

9. A set of electrical terminals as claimed in claim 1 wherein the set is formed from a single blank of material.

10. A set of electrical terminals as claimed in claim 1, wherein the slots are insulation displacement slots.

11. A set of electrical terminals comprising multiple electrical terminals where each terminal includes a first pair of spring arms and a second pair of spring arms, each pair of spring arms defining a lead receiving slot therebetween that is open to receive a lead therein, the first and second pairs of spring arms of each of the terminals extend from a front and rear wall respectively, a strain relief ferrule aligned with each one of the slots for retaining the lead inserted therein, wherein the strain relief ferrules are disposed adjacent to each other, and one of the strain relief ferrules extends from the front wall while one of the other ferrules extends from the rear wall, whereby the strain relief ferrules may be positioned on a close pitch.

12. A set of terminals according to claim 11, wherein the strain relief ferrules from one wall are interdigitated with the strain relief ferrules of the other.

13. A set of terminals according to claim 12, wherein the strain relief ferrules extending from one of the walls are extended therefrom by a base portion that is folded under the pairs of spring arms.

14. A set of terminals according to claim 13, wherein a carrier strip extends from the base to interconnect with adjacently formed sets of terminals, whereby any desired number of sets of terminals may be interconnected.

15. A set of terminals according to claim 14, wherein each set further comprises an insulative housing formed thereabout.

16. A set of terminals according to claim 15, wherein adjacent insulative housings are frangibly connected together.

17. A method of manufacturing a set of terminals, characterised by the steps of;

providing an elongate sheet metal blank from one end of which projects a pair of spaced, juxtaposed, lead strain relief ferrule forming portions and from the opposite end of which projects a third lead strain relief ferrule forming portion, a row of lead receiving terminal forming portions being disposed between said ends of the blank; and, rolling up said pair of ferrule forming portions and said third ferrule forming portion in opposite senses to provide lead strain relief ferrules disposed adjacently on a common side of the set of terminals.

* * * * *